US010851434B2

(12) United States Patent
Saito et al.

(10) Patent No.: US 10,851,434 B2
(45) Date of Patent: Dec. 1, 2020

(54) STEEL SHEET FOR CAN AND METHOD FOR MANUFACTURING THE SAME

(71) Applicant: JFE STEEL CORPORATION, Chiyoda-ku, Tokyo (JP)

(72) Inventors: Hayato Saito, Fukuyama (JP); Mikito Suto, Chiba (JP); Katsumi Kojima, Fukuyama (JP); Hiroki Nakamaru, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 925 days.

(21) Appl. No.: 15/128,667

(22) PCT Filed: Mar. 23, 2015

(86) PCT No.: PCT/JP2015/001635
§ 371 (c)(1),
(2) Date: Sep. 23, 2016

(87) PCT Pub. No.: WO2015/146137
PCT Pub. Date: Oct. 1, 2015

(65) Prior Publication Data

US 2017/0107592 A1 Apr. 20, 2017

(30) Foreign Application Priority Data

Mar. 28, 2014 (JP) ..... 2014-067293

(51) Int. Cl.

| | |
|---|---|
| ***C21D 9/46*** | (2006.01) |
| ***C22C 38/06*** | (2006.01) |
| ***B65D 1/12*** | (2006.01) |
| ***C22C 38/02*** | (2006.01) |
| ***C22C 38/00*** | (2006.01) |
| ***C22C 38/14*** | (2006.01) |
| ***C22C 38/04*** | (2006.01) |
| ***C21D 8/02*** | (2006.01) |

(52) U.S. Cl.
CPC ..... *C21D 9/46* (2013.01); *B65D 1/12* (2013.01); *C21D 8/0226* (2013.01); *C21D 8/0236* (2013.01); *C21D 8/0263* (2013.01); *C21D 8/0268* (2013.01); *C22C 38/00* (2013.01); *C22C 38/001* (2013.01); *C22C 38/002* (2013.01); *C22C 38/004* (2013.01); *C22C 38/02* (2013.01); *C22C 38/04* (2013.01); *C22C 38/06* (2013.01); *C22C 38/14* (2013.01)

(58) Field of Classification Search
CPC ..... C21D 9/46; C21D 8/0026; C21D 8/0236; C21D 8/0263; C21D 8/0268; C22C 38/00; C22C 38/001; C22C 38/002; C22C 38/004; C22C 38/02; C22C 38/04; C22C 38/06; C22C 38/14; B65D 1/12
See application file for complete search history.

(56) References Cited

U.S. PATENT DOCUMENTS 5,587,027 A * 12/1996 Tosaka ..... C22C 38/04 148/320
2014/0034195 A1 2/2014 Suto et al.

FOREIGN PATENT DOCUMENTS

| | | | |
|---|---|---|---|
| CN | 1118814 | A | 3/1996 |
| CN | 1230231 | A | 9/1999 |
| CN | 101275196 | A | 10/2008 |
| CN | 102482748 | A | 5/2012 |
| EA | 0 917 594 | B1 | 11/2000 |
| EP | 0 672 758 | A1 | 9/1995 |
| EP | 2 468 909 | A1 | 6/2012 |
| JP | H06-212353 | A | 8/1994 |
| JP | 2000-054070 | A | 2/2000 |
| JP | 2001-247917 | A | 9/2001 |
| JP | 2012-107315 | A | 6/2012 |
| JP | 2012-233255 | A | 11/2012 |
| WO | 2008/133175 | A1 | 11/2008 |

OTHER PUBLICATIONS

Dec. 19, 2017 Office Action issued in Korean Patent Application No. 10-2016-7029697.
Apr. 17, 2017 Office Action issued in Chinese Patent Application No. 201580016388.7.
Sep. 25, 2017 Office Action issued in Chinese Patent Application No. 201580016388.7.
Feb. 23, 2018 Office Action issued in Chinese Patent Application No. 201580016388.7.

* cited by examiner

*Primary Examiner* — Colleen P Dunn
*Assistant Examiner* — Anthony M Liang
(74) *Attorney, Agent, or Firm* — Oliff PLC

(57) ABSTRACT

A steel sheet for a can having sufficient hardness and a method for manufacturing the steel sheet. The steel sheet has a chemical composition containing, by mass %, C: 0.0005% or more and 0.0030% or less, Si: 0.05% or less, Mn: 0.50% or more and 1.00% or less, P: 0.030% or less, S: 0.020% or less, Al: 0.01% or more and 0.04% or less, N: 0.0010% or more and 0.0050% or less, B: 0.0005% or more and 0.0050% or less, and Fe and inevitable impurities. Additionally, the steel sheet has a hardness (HR30T) of 56 or more, and an average Young's modulus of 215 GPa or more.

8 Claims, No Drawings

STEEL SHEET FOR CAN AND METHOD FOR MANUFACTURING THE SAME

TECHNICAL FIELD

The present disclosure relates to a steel sheet for a can which is suitable for a can container material used for foods and beverages and a method for manufacturing the steel sheet. In particular, the present disclosure relates to a steel sheet for a can having excellent buckling strength of a can barrel against external pressure, which is suitable for a steel sheet for two-piece cans, and a method for manufacturing the steel sheet.

BACKGROUND ART

Nowadays, since there is a demand for decreasing the amount of steel sheet used for cans for foods and beverages from the viewpoint of decreasing the environmental load and cost, the thickness of a steel sheet is being reduced regardless of whether the steel sheet is used for two-piece cans or three-piece cans. The reduction of the thickness of a steel sheet is accompanied by a decrease in the strength and rigidity of can bodies. Therefore, the deformation of a can body due to an external force and the buckling deformation of a can barrel due to a change in the internal pressure of the can are regarded as problems. The external force is applied when the can is handled in a can manufacturing process, in a transporting process, and at the market. The change in the internal pressure of the can occurs when, for example, a heat sterilization treatment is performed on contents.

Conventionally, the strength of steel sheets has been increased in order to increase resistance to the buckling deformation described above. However, when the hardness of a steel sheet increase due to an increase in the strength of the steel sheet, there is a decrease in formability. As a result, the rate of occurrence of neck wrinkling or flange cracking increases when neck forming following can barrel formation is performed or when flange forming is performed thereafter, which is a problem in terms of formability. Therefore, increasing the strength of a steel sheet is not necessarily an appropriate method for solving the problem of buckling deformation due to a decrease in the thickness of the steel sheet.

Buckling deformation of a can barrel occurs due to a deterioration in the rigidity of the can body caused by a decrease in the thickness of the can barrel. Therefore, it is thought that an increase in the rigidity of a steel sheet by increasing Young's modulus of the steel sheet allows an increase in buckling deformation resistance (also referred to as "paneling strength"). In particular, when a two-piece can is formed through a drawing process, since the circumferential direction of the formed can barrel does not correspond to a particular direction of a steel sheet, it is possible to increase buckling deformation resistance by increasing the average Young's modulus in the plane of the steel sheet.

In addition, there is a strong correlation between Young's modulus of steel and the crystal orientation of a steel sheet. A crystal orientation group (a fiber), in which the <110> orientation is parallel to the rolling direction, is grown due to rolling, and particularly increases Young's modulus in a direction at a right angle to the rolling direction. In addition, a crystal orientation group (γ fiber), in which the <111> orientation is parallel to the normal direction of a sheet plane, can increase Young's modulus to about 220 GPa in directions at angles of 0°, 45°, and 90° to the rolling direction. On the other hand, Young's modulus of a steel sheet, in which a crystal orientation is not integrated in a. particular direction in the steel sheet, that is, a steel sheet having a random texture, is about 205 GPa.

As an example of a technique in which Young's modulus (elastic modulus) of a steel sheet is increased in order to increase the rigidity of a can body, Patent Literature 1 discloses a high-rigidity steel sheet for a container, the steel sheet being a rolled steel sheet having a chemical composition containing, by wt. %, C: 0.0020% or less, P: 0.05% or less, S: 0.008% or less, Al: 0.005% to 0.1%, N: 0.004% or less, at least one of Cr, Ni, Cu, Mo, Mn, and Si in an amount of 0.1% to 0.5% in total, and the balance being Fe and inevitable impurities, a deformed microstructure in which the average ratio of the major axis to the minor axis of crystal grains is 4 or more, and a maximum elasticity modulus of 230000 MPa or more. Patent Literature 1 discloses that Young's modulus in a direction at an angle of 90° to the rolling direction is increased as a result of forming a strong rolling texture by performing cold rolling and annealing the steel having the chemical composition described above followed by second cold rolling with a rolling reduction of 50% or more, which results in an increase in the rigidity of a steel sheet.

In addition, Patent Literature 2 discloses a high-strength steel sheet for a can, the steel sheet having a chemical composition containing, by mass %, C: 0.003% or less, Si: 0.02% or less, Mn: 0.05% to 0.60%, P: 0.02% or less, S: 0.02% or less, Al: 0.01% to 0.10%, N: 0.0010% to 0.0050%, Nb: 0.001% to 0.05%, B: 0.0005% to 0.002%, and the balance being Fe and inevitable impurities, in which (the integrated intensity of {112}<110> orientation)/(the integrated intensity of {111}<112> orientation) is 1.0 or more in the central portion in the thickness direction, a tensile strength in a direction at an angle of 90° to the rolling direction is 550 MPa to 800 MPa, and Young's modulus in a direction at an angle of 90° to the rolling direction is 230 GPa or more.

Patent Literature 3 discloses a steel sheet for a can owning a can barrel with high buckling strength against external pressure excellent in terms of formability and surface quality after forming, the steel sheet having a chemical composition containing, by mass %, C: 0.0005% or more and 0.0035% or less, Si: 0.05% or less, Mn: 0.1% or more and 0.6% or less, P; 0.02% or less, S: less than 0.02%, Al: 0.01% or more and less than 0.10%, N: 0.0030% or less, B: 0.0010% or more, and the balance being Fe and inevitable impurities, in which B/N is 3.0 or less (B/N=(B (mass %))/10.81)/(N (mass %)/14.01)), and a texture where an average integrated intensity f of (111) [1-10] to (111)[−1-12] orientations in a plane at ¼ of the thickness of the steel sheet is 7.0 or more, in which the relationships $E_{AVE} \geq 215$ GPa, $E_0 \geq 210$ GPa, $E_{45} \geq 210$ GPa, $E_{90} \geq 210$ GPa, and $-0.4 \leq \Delta r \leq 0.4$ are satisfied and an average ferrite grain diameter of a cross section in the rolling direction is 6.0 μm to 10.0 μm.

CITATION LIST

Patent Literature

PTL 1: Japanese Unexamined Patent Application Publication No. 6-212353

PTL 2: Japanese Unexamined Patent Application Publication No. 2012-107315

PTL 3: Japanese Unexamined Patent Application Publication No. 2012-233255

SUMMARY

Technical Problem

However, the conventional techniques described above have the following problems. In the case of the technique disclosed in Patent Literature 1, there is a problem in that neck formability and flange formability decrease due to second rolling with a high rolling reduction of 50% or more. In addition, there is a problem in that, since a rolling texture only grows, anisotropy increases, which results in a decrease in the average Young's modulus. In the case of the technique disclosed in Patent Literature 2, there is a problem in that, although formability corresponding to that required for a welded can is achieved by performing recovery annealing, it is not possible to use the steel sheet in applications requiring a higher level of formability such as drawing or ironing which is used for forming a two-piece can. In the case of the technique disclosed in Patent Literature 3, although it is possible to achieve excellent buckling resistance, there is a problem in that a steel sheet having sufficient hardness against deformation of a can body due to the application of an external force may not necessarily be obtained when a can is handled in a can making process, in a transporting process, and at the market.

That is, there has been neither a steel sheet having sufficient hardness against the deformation of a can body and having a sufficiently high Young's modulus to increase the rigidity of a can body nor a method for manufacturing the steel sheet.

The disclosed embodiments have been completed in view of the situation described above, and an object of the present disclosure is, by solving the problems with the conventional techniques described above, to provide a steel sheet for a can having sufficient hardness and owning a can barrel with excellent buckling strength against external pressure and a method for manufacturing the steel sheet.

Solution to Problem

The present inventors diligently conducted investigations in order to solve the problems described above. As a result, the present inventors found that, by optimizing chemical composition, hot rolling conditions, cold rolling conditions, annealing conditions, and second cold rolling conditions, it is possible to manufacture a steel sheet for a can having a hardness of 56 or more in terms of HR30T and the average Young's modulus of 215 GPa or more, that is, having sufficient hardness against the deformation of a can body and owning a can barrel with excellent buckling strength against external pressure. Exemplary embodiments of the present disclosure may include as follows.

[1] A steel sheet for a can, comprising:

a chemical composition containing, by mass %, C: 0.0005% or more and 0.0030% or less, Si: 0.05% or less, Mn: 0.50% or more and 1.00% or less, P: 0.030% or less, S: 0.020% or less, Al: 0.01% or more and 0.04% or less, N: 0.0010% or more and 0.0050% or less, B: 0.0005% or more and 0.0050% or less, and the balance being Fe and inevitable impurities, a hardness (HR30T) of 56 or more, and the average Young's modulus of 215 GPa or more.

[2] The steel sheet for a can according to item [1], wherein the steel sheet has the chemical composition further containing, by mass %, Ti: 0.005% or more and 0.020% or less, a hardness (HR30T) of 56 or more, and an average Young's modulus of 215 GPa or more.

[3] A method for manufacturing a steel sheet for a can, including:

hot-rolling a steel slab having the chemical composition according to item [1] or [2] with a finishing delivery temperature of 800° C. or higher and 950° C. or lower, coiling the hot-rolled steel sheet at a coiling temperature of 500° C. or higher and 700° C. or lower, cold-rolling the coiled steel sheet with a rolling reduction of 85% or more, annealing the cold-rolled steel sheet at an annealing temperature of 680° C. or higher and 780° C. or lower, and performing second cold rolling with a rolling reduction of 5% or more and 15% or less.

Advantageous Effects

By using the steel sheet for a can according to the disclosed embodiments, it is possible to easily manufacture a can body which has a hardness necessary in a can manufacturing process and a transporting process and whose can barrel has a higher buckling strength against external pressure than the standard value (about 1.5 kgf/cm$^2$) set by can manufacturers and beverage manufacturers, that is, a can body having sufficient hardness and sufficient rigidity. Therefore, since it is possible to realize a higher level of thickness reduction of a steel sheet, it is possible to realize resource saving and cost reduction, which has a marked effect on the industry. In addition, it is expected that the steel sheet according to the present disclosure will be used not only for various metal cans but also for a wide range of applications such as internal cans of dry-cell batteries, various home electrical appliances, various electrical parts, and automobile parts.

DESCRIPTION OF EMBODIMENTS

First, the reasons for limitations on the chemical composition will be described. Here, "%" used when describing the contents of the constituent chemical elements refers to "mass %", unless otherwise noted.

C: 0.0005% or more and 0.0030% or less

The lower the C content, the more the texture grows in a cold rolling process and an annealing process. In particular, γ fibers, which are important for increasing the average Young's modulus, grow. Therefore, it is necessary that the upper limit of the C content be 0.0030%. On the other hand, C is a chemical element which contributes to an increase in the hardness of a steel sheet and to a decrease in the grain diameter of an annealed steel sheet, and it is necessary that the C content be 0.0005% or more in order to realize such effects. Here, it is preferable that the C content be 0.0010% or more from the viewpoint of achieving satisfactory hardness.

Si: 0.05% or less

When the Si content is large, since there is a decrease in surface treatability due to surface concentration, there is a decrease in corrosion resistance. Therefore, it is necessary that the Si content be 0.05% or less, or preferably 0.02% or less.

Mn: 0.50% or more and 1.00% or less

Mn is an important chemical element in the disclosed embodiments and is effective for increasing the hardness of a steel sheet through solid solution hardening and for increasing the average Young's modulus by growing a texture through a decrease in the grain diameter of a hot-rolled steel sheet. In addition, by forming MnS, Mn is effective for preventing a decrease in hot ductility from occurring due to S contained in steel. In order to realize such effects, it is necessary that the Mn content be 0.50% or more. Moreover, in the disclosed embodiments, Mn is effective for increasing the denting strength of a can body by promoting work hardening when work in a can manufacturing process such as drawing or ironing is performed. Therefore, it is preferable that the Mn content be more than 0.60%, or more preferably 0.65% or more. On the other hand, when the Mn content is more than 1.00%, since a texture is less likely to grow in an annealing process, in particular, there is a decrease in the integration degree of (111) [1-21] orientation, which results in a decrease in the average Young's modulus. Therefore, the upper limit of the Mn content is set to be 1.00%.

P: 0.030% or less

When the P content is large, there is a decrease in formability due to an excessive increase in hardness and central segregation, and there is a decrease in corrosion resistance. Therefore, the upper limit of the P content is set to be 0.030%. It is preferable that the P content be 0.020% or less.

S: 0.020% or less

S decreases hot ductility by forming sulfides in steel. Therefore, the upper limit of the S content is set to be 0.020%. It is preferable that the S content be 0.015% or less.

Al: 0.01% or more and 0.04% or less

Al is a chemical element which is added as a deoxidizing agent. In addition, Al is effective for increasing formability and ageing resistance by decreasing the amount of a solid solution N in steel as a result of combining with N to form AlN. In order to realize such effects, it is necessary that the Al content be 0.01% or more. However, when the Al content is excessively large, the effects become saturated, and there is a decrease in formability due to an increase in the amount of inclusions such as alumina. Therefore, it is necessary that the upper limit of the Al content be 0.04%. Here, when BN is formed instead of AlN, since there is a decrease in the amount of B, which is effective for decreasing grain diameter, there is a decrease in hardness. Therefore, from the viewpoint of forming AlN in priority to BN, it is preferable that [Al]/[B] be more than 0.6, or more preferably 6.0 or more.

N: 0.0010% or more and 0.0050% or less

N increases hardness by combining with, for example, Al and B to form nitrides and carbonitrides. On the other hand, since N decreases hot ductility, it is preferable that the N content be as small as possible. In addition, when the N content is large, since texture growth is inhibited, there is a decrease in the average Young's modulus. Therefore, the upper limit of the N content is set to be 0.0050%. It is preferable that the N content be 0.0035% or less. As described above, it is preferable that the N content be as small as possible. However, when the N content is less than 0.0010%, the effect on texture becomes saturated, and it is not possible to realize the effect of increasing hardness due to nitrides. Therefore, the lower limit of the N content is set to be 0.0010%.

B: 0.0005% or more and 0.0050% or less

Since B is effective for decreasing the grain diameter of a hot-rolled steel sheet by lowering the Ar3 transformation temperature, B is effective for promoting texture growth and for inhibiting grain growth in an annealing process. In addition, B is effective for increasing hardness by decreasing the grain diameter of an annealed steel sheet. In order to realize such effects, it is necessary that the lower limit of the B content be 0.0005%, or preferably 0.0010%. On the other hand, when the B content is more than 0.0050%, since B tends to be precipitated in the form of BN and Fe—B compounds, it is not possible to realize the effects described above. Therefore, it is necessary that the upper limit of the B content be 0.0050%. It is preferable that the B content be 0.0035% or less.

In addition to the chemical composition described above, it is preferable to add the following chemical element.

Ti: 0.005% or more and 0.020% or less

Since Ti inhibits the formation of BN as a result of combining with N and forming nitrides in priority to BN, Ti is effective for maintaining the amount of B, which is effective for decreasing grain diameter. In addition, since Ti promotes texture growth by decreasing the grain diameter of a hot-rolled steel sheet through the pinning effect of TiN and TIC, Ti is effective for increasing the average Young's modulus. Therefore, it is preferable that the Ti content be 0.005% or more. Since the effect of decreasing the grain diameter of a hot-rolled steel sheet due to the addition of Ti is noticeable when the Mn content is more than 0.6%, it is particularly preferable that Ti be added when the Mn content is more than 0.6%. It is more preferable that the Ti content be 0.008% or more from the viewpoint of fixing N. On the other hand, when Ti content is excessively large, since the pinning effect is eliminated due to an increase in the grain diameter of nitrides and carbides, the effect of decreasing the grain diameter is eliminated. Therefore, it is preferable that the upper limit of the Ti content be 0.020%.

The balance is Fe and inevitable impurities.

Hereafter, the material properties will be described.

Hardness (HR30T): 56 or more

In order to prevent plastic deformation from occurring when a can is subjected to a load due to, for example, handling in a can making process and a transporting process, it is necessary to increase the hardness of a steel sheet. Therefore, it is necessary that Rockwell superficial hardness (HR30T) be 56 or more, or preferably 58 or more. Although there is no particular limitation on the upper limit of the hardness, there is a decrease in formability when an excessive increase in hardness, there is a decrease in the denting strength and paneling strength of a can body due to non-uniformity in the shape of a can body after a can making process, and cracking occurs when flange forming is performed. Therefore, it is preferable that the hardness be 70 or less, or more preferably 66 or less. Here, in the present disclosure, the hardness (HR30T) is determined by using the method described in the EXAMPLES below. In order to achieve the hardness according to the present disclosure, it is appropriate to control the chemical composition in accordance with the present disclosure, to decrease the ferrite grain diameter of a hot-rolled steel sheet by controlling the finishing delivery temperature and coiling temperature of hot rolling to be the specified temperatures, to inhibit an increase in ferrite grain diameter in an annealed steel sheet while promoting recrystallization by controlling the annealing temperature to be the specified temperature, and to perform second cold rolling with the specified rolling reduction.

Average Young's modulus; 215 GPa or more

When a container such as a two-piece can where drawing is performed, the direction of the can barrel after a can making process does not correspond to a particular direction of a steel sheet. Therefore, by increasing the average Young's modulus in the surface of the steel sheet, it is possible to increase the buckling strength of the can barrel. By controlling the average Young's modulus, which is calculated to be equal to (E[L]+2E[D]+E[C])/4 from Young's modulus (E[L]) in the rolling direction, Young's modulus (E[D]) in a direction at an angle of 45° to the rolling direction, and Young's modulus (E[C]) in a direction at a right angle to the rolling direction, to be 215 GPa or more, or preferably 225 GPa or more, it is possible to realize the effect of increasing the buckling strength of the can barrel. In addition, although there is no particular limitation on the upper limit of the average Young's modulus, it is preferable that the average Young's modulus be 230 GPa or less from the viewpoint of having satisfactory hardness at the same time. Here, in the present disclosure, the average Young's modulus is determined by using the method described in the EXAMPLES below. In order to achieve the average Young's modulus according to the present disclosure it is appropriate to control chemical the composition in accordance with the present disclosure, to decrease the ferrite grain diameter of a hot-rolled steel sheet by controlling the finishing delivery temperature and coiling temperature of hot rolling to be the specified temperatures so that texture growth in a cold rolling process is promoted, and to grow a texture mainly including γ fibers after a recrystallization process by controlling the annealing temperature to be the specified temperature. In addition, from the viewpoint of achieving a high average Young's modulus by maintaining the texture after second cold rolling has been performed, the rolling reduction of second cold rolling is set to be 15% or less.

Hereafter, one example of a method for manufacturing the steel sheet for a can will be described.

The steel sheet for a can according to some embodiments is manufactured by hot-rolling a steel slab having the chemical composition described above with a finishing delivery temperature of 800° C. or higher and 950° C. or lower, by coiling the hot-rolled steel sheet at a coiling temperature of 500° C. or higher and 700° C. or lower, by cold-rolling the coiled steel sheet with a rolling reduction of 85% or more, by annealing the cold-rolled steel sheet at an annealing temperature of 680° C. or higher and 780° C. or lower, and by then performing second cold rolling with a rolling reduction of 5% or more and 15% or less.

Finishing Delivery Temperature of Hot Rolling: 800° C. or Higher and 950° C. or Lower When the finishing delivery temperature of hot rolling is higher than 950° C., since there is an increase in the grain diameter of a hot-rolled steel sheet, texture growth is inhibited. In addition, since there is an increase in the grain diameter of an annealed steel sheet due to an increase in the grain diameter of the hot-rolled steel sheet, there is a decrease in hardness. Therefore, the finishing delivery temperature of hot rolling is set to be 950° C. or lower. On the other hand, when the finishing delivery temperature of hot rolling is lower than 800° C., since rolling is performed at a temperature of the Ar3 transformation temperature or less, a texture is less likely to grow due to an increase in grain diameter and retained rolled microstructure. Therefore, the finishing delivery temperature of hot rolling is set to be 800° C. or higher, or preferably 850° C. or higher. Here, it is not necessary to put a particular limitation on a slab heating temperature before hot rolling is performed. However, when Ti is added, it is preferable that the slab heating temperature be 1100° C. or higher from the viewpoint of re-dissolving TiC and TiN which have a large grain diameter and exist in the slab.

Coiling temperature: 500° C. or higher and 700° C. or lower

When the coiling temperature is higher than 700° C., since there is an increase in the grain diameter of an annealed steel sheet due to an increase in the grain diameter of a hot-rolled steel sheet, there is a decrease in hardness. In addition, since texture growth is inhibited due to an increase in the grain diameter of a hot-rolled steel sheet, there is a decrease in the average Young's modulus. Therefore, the coiling temperature is set to be 700° C. or lower, preferably 650° C. or lower, or more preferably 600° C. or lower. When the coiling temperature is excessively low, since the precipitation of C and N does not sufficiently occur, texture growth in a cold rolling process and an annealing process is inhibited due to large amounts of retained solid solutions of C and N.

Therefore, the coiling temperature is set to be 500° C. or higher.

After coiling has been performed as described above, it is preferable that surface scale is removed before cold rolling is performed. It is possible to remove surface scale by using, for example, pickling and a physical removing method. Pickling and a physical removing method may be used separately or in combination. There is no particular limitation on pickling conditions as long as surface scale is removed. Pickling may be performed by using an ordinary method.

Rolling Reduction of Cold Rolling: 85% or More

The rolling reduction of cold rolling is set to be 85% or more in order to increase the average Young's modulus due to texture growth and to achieve the specified hardness due to a decrease in grain diameter. When the rolling reduction is less than 85%, there is a decrease in the average Young's modulus due to insufficient growth of a texture, and it is not possible to achieve the specified hardness due to an increase in grain diameter. Here, it is preferable that the rolling reduction be 88% or more from the viewpoint of texture growth.

Annealing Temperature: 680° C. or Higher and 780° C. or Lower

From the viewpoint of texture growth due to recrystallization and grain growth, the annealing temperature is set to be 680° C. or higher. When the annealing temperature is excessively high, since there is an increase in grain diameter, and since there is an increase in the grain diameter of NbC, there is a decrease in hardness. Therefore, the annealing temperature is set to be 780° C. or lower, or preferably 750° C. or lower. Here, from the viewpoint of increasing Young's modulus by growing a texture, it is preferable to perform annealing with a soaking time of 10 seconds or more. In addition, there is no particular limitation on what method is used for annealing. However, it is preferable to use a continuous annealing method from the viewpoint of the uniformity of material properties.

Rolling Reduction of Second Cold Rolling: 5% or More and 15% or Less

The hardness of a steel sheet is increased through work hardening by performing second cold rolling. As a result, it is possible to prevent plastic deformation from occurring when a can is subjected to a load due to, for example, handling in a can making process and a transporting process. Therefore, the rolling reduction is set to be 5% or more, preferably more than 5.0%, or more preferably 60% or more. When second cold rolling is performed with an excessively large rolling reduction, there is a decrease in the average Young's modulus due to a significant decrease in formability and a deterioration in anisotropy. Therefore, the rolling reduction is set to be 15% or less, or preferably 12% or less.

With the method described above, it is possible to obtain a steel sheet for a can having sufficient hardness and owning a can barrel with excellent buckling strength against external pressure.

Example 1

By preparing molten steels having the chemical compositions corresponding to the steel codes A through S given in Table 1, steel slabs were obtained. Under the conditions given in Table 2, the obtained steel slabs were heated, hot-rolled, pickled in order to remove scale, then cold-rolled, and annealed with a soaking time of 15 seconds by using a continuous annealing furnace. Subsequently, by performing second cold rolling, steel sheets (steel sheet codes 1 through 28) having a thickness of 0.220 mm were obtained.

TABLE 1

| Steel Code | C mass % | Si mass % | Mn mass % | P mass % | S mass % | Al mass % | N mass % | B mass % | Ti mass % | Al/B | Note |
|---|---|---|---|---|---|---|---|---|---|---|---|
| A | 0.0024 | 0.01 | 0.60 | 0.010 | 0.012 | 0.03 | 0.0025 | 0.0015 | — | 20.0 | within Scope of Invention |
| B | 0.0020 | 0.01 | 0.60 | 0.010 | 0.010 | 0.02 | 0.0020 | 0.0011 | 0.011 | 18.2 | within Scope of Invention |
| C | 0.0012 | 0.01 | 0.65 | 0.012 | 0.010 | 0.04 | 0.0020 | 0.0020 | — | 20.0 | within Scope of Invention |
| D | 0.0010 | 0.02 | 0.80 | 0.010 | 0.015 | 0.03 | 0.0030 | 0.0022 | — | 13.6 | within Scope of Invention |
| E | 0.0020 | 0.01 | 0.60 | 0.012 | 0.008 | 0.02 | 0.0016 | 0.0019 | 0.020 | 10.5 | within Scope of Invention |
| F | 0.0018 | 0.01 | 0.60 | 0.010 | 0.010 | 0.02 | 0.0025 | 0.0008 | 0.005 | 25.0 | within Scope of Invention |
| G | 0.0020 | 0.01 | 0.60 | 0.011 | 0.012 | 0.03 | 0.0030 | 0.0035 | — | 8.6 | within Scope of Invention |
| H | 0.0022 | 0.01 | 0.50 | 0.009 | 0.012 | 0.01 | 0.0023 | 0.0016 | 0.012 | 6.3 | within Scope of Invention |
| I | 0.040 | 0.01 | 0.55 | 0.010 | 0.013 | 0.02 | 0.0024 | 0.0013 | — | 15.4 | out of Scope of Invention |
| J | 0.0020 | 0.01 | 0.30 | 0.010 | 0.012 | 0.01 | 0.0018 | 0.0020 | — | 5.0 | out of Scope of Invention |
| K | 0.0020 | 0.03 | 1.50 | 0.013 | 0.013 | 0.02 | 0.0010 | 0.0014 | — | 14.3 | out of Scope of Invention |
| L | 0.0020 | 0.02 | 0.70 | 0.010 | 0.010 | 0.02 | 0.0040 | 0.0002 | — | 100.0 | out of Scope of Invention |
| M | 0.0020 | 0.01 | 0.63 | 0.020 | 0.008 | 0.03 | 0.0033 | 0.0067 | — | 4.5 | out of Scope of Invention |
| N | 0.0043 | 0.01 | 0.66 | 0.010 | 0.012 | 0.03 | 0.0022 | 0.0008 | — | 37.5 | out of Scope of Invention |
| O | 0.0030 | 0.01 | 0.65 | 0.009 | 0.011 | 0.02 | 0.0023 | 0.0023 | — | 8.7 | within Scope of Invention |
| P | 0.0022 | 0.01 | 0.70 | 0.008 | 0.011 | 0.04 | 0.0018 | 0.0036 | — | 11.1 | within Scope of Invention |
| Q | 0.0016 | 0.01 | 0.61 | 0.012 | 0.009 | 0.04 | 0.0032 | 0.0033 | — | 12.1 | within Scope of Invention |
| R | 0.0023 | 0.01 | 0.65 | 0.010 | 0.008 | 0.03 | 0.0025 | 0.0023 | 0.018 | 13.0 | within Scope of Invention |
| S | 0.0022 | 0.01 | 0.67 | 0.015 | 0.012 | 0.03 | 0.0022 | 0.0021 | 0.006 | 14.3 | within Scope of Invention |

* An underlined portion indicates a value out of the range according to the present invention.

TABLE 2

| Steel Sheet Code | Steel Code | Slab Heating Temperature ° C. | Finishing Delivery Temperature ° C. | Coiling Temperature ° C. | Rolling Reduction of Cold Rolling % | Annealing Temperature ° C. | Rolling Reduction of Second Cold Rolling % | Note |
|---|---|---|---|---|---|---|---|---|
| 1 | A | 1200 | 880 | 560 | 91 | 710 | 7.0 | Example |
| 2 | A | 1200 | 970 | 550 | 89 | 720 | 7.0 | Comparative Example |
| 3 | A | 1280 | 760 | 580 | 89 | 700 | 8.0 | Comparative Example |
| 4 | A | 1180 | 890 | 730 | 90 | 720 | 7.0 | Comparative Example |
| 5 | A | 1200 | 860 | 420 | 90 | 720 | 6.0 | Comparative Example |
| 6 | A | 1200 | 860 | 580 | 80 | 720 | 8.0 | Comparative Example |
| 7 | A | 1150 | 910 | 560 | 92 | 650 | 10.0 | Comparative Example |
| 8 | A | 1200 | 920 | 560 | 89 | 790 | 6.5 | Comparative Example |
| 9 | A | 1220 | 860 | 620 | 90 | 700 | 1.8 | Comparative Example |
| 10 | A | 1200 | 880 | 570 | 90 | 710 | 30.0 | Comparative Example |
| 11 | B | 1220 | 890 | 560 | 92 | 750 | 7.0 | Example |
| 12 | C | 1220 | 930 | 630 | 90 | 780 | 9.0 | Example |
| 13 | D | 1200 | 900 | 580 | 90 | 750 | 10.0 | Example |
| 14 | E | 1200 | 860 | 560 | 92 | 750 | 5.0 | Example |
| 15 | F | 1180 | 900 | 600 | 92 | 710 | 12.0 | Example |
| 16 | G | 1200 | 890 | 550 | 91 | 750 | 6.0 | Example |
| 17 | H | 1200 | 850 | 620 | 88 | 750 | 10.0 | Example |
| 18 | I | 1200 | 890 | 580 | 90 | 750 | 6.0 | Comparative Example |
| 19 | J | 1200 | 890 | 580 | 89 | 750 | 7.0 | Comparative Example |
| 20 | K | 1200 | 890 | 580 | 89 | 760 | 7.0 | Comparative Example |
| 21 | L | 1230 | 890 | 570 | 89 | 750 | 6.5 | Comparative Example |
| 22 | M | 1200 | 890 | 580 | 89 | 750 | 10.0 | Comparative Example |
| 23 | N | 1200 | 870 | 570 | 86 | 700 | 5.5 | Comparative Example |
| 24 | O | 1200 | 880 | 550 | 88 | 690 | 6.0 | Example |
| 25 | P | 1200 | 890 | 560 | 89 | 710 | 6.0 | Example |
| 26 | Q | 1150 | 880 | 600 | 89 | 710 | 7.0 | Example |
| 27 | R | 1200 | 900 | 580 | 88 | 700 | 7.0 | Example |
| 28 | S | 1200 | 860 | 550 | 88 | 720 | 10.0 | Example |

* An underlined portion indicates a value out of the range according to the present invention.

The properties of the steel sheets obtained as described above were evaluated by using the following methods.

Evaluation of Average Young's Modulus

By taking test pieces having a size of 10 mm×35 mm so that the longitudinal directions of the test pieces are respectively at angles of 0°, 45°, and 90° to the rolling direction, and by determining Young's moduli (GPa) in the three directions by using a resonant frequency measuring machine of a transverse oscillation type in accordance with the standard (C1259) produced by the American Society for Testing Materials, the average Young's modulus was calculated to be equal to (E[L]+2E[D]+E[C])/4.

Hardness (HR30T)

A Rockwell superficial hardness in terms of 30T scale (HR30T) was determined at a position prescribed in JIS G 3315 in accordance with "Rockwell hardness test-Test method" in JIS Z 2245.

Buckling Strength of a can Body after a can Manufacturing Process

By performing a chromium plating (tin free) treatment as a surface treatment on the obtained steel sheets, and by coating the treated steel sheets with an organic film, laminated steel sheets were manufactured. By punching a disk from the laminated steel sheet, and by performing, for example, deep drawing followed by ironing on the disk in order to form a can body equivalent to a two-piece can used as a beverage can, the can body was used for determination. The determination method is as follows. The can body was placed in a pressurized chamber and pressurized. The pressure inside the pressurized chamber was increased at a rate of 0.016 MPa/sec by feeding pressurized air into the chamber through an air inlet valve, and pressurization was stopped when the buckling of the can occurred. The pressure inside the chamber was observed by using a pressure gage, a pressure sensor, an amplifier which amplifies the signal detected by the sensor, and a signal processing machine which, for example, displays the detected signal and processes the detected data. The buckling pressure was defined as a pressure corresponding to a pressure-changing point due to buckling. Generally, in the case of a pressure change due to a heat sterilization treatment, a strength against external pressure required is more than 0.15 MPa. Therefore, a case where the strength against external pressure was higher than 0.16 MPa was judged as ⊙, a case where the strength against external pressure was higher than 0.15 MPa and 0.16 MPa or lower was judged as ○, and a case where the strength against external pressure was 0.15 MPa or lower was judged as x (unsatisfactory).

Denting Test

By forming a can body similar to that used when determining buckling strength, and by using the following method, denting strength was determined. By vertically compressing an indenter having a tip radius of 5 mm and a length of 40 mm to the central part of the can barrel while the longitudinal direction of the indenter was kept parallel to the height direction of the can body, by determining the compression distance and the compression load, and by reading the load immediately before buckling occurred, that is, the load immediately before the slope of the load against the compression distance was decreased to a certain constant slope, denting strength was defined as the read value. A case where the denting strength was 75 N or more was judged as a very good result indicated by ⊙, a case where the denting strength was 70 N or more and less than 75 N was judged as a good result indicated by ○, and a case where the denting strength was less than 70 N was judged as the case of insufficient denting strength indicated by x (unsatisfactory).

The results are given in Table 3.

TABLE 3

| Steel Sheet Code | HR30T Hardness | Average Young's Modulus GPa | Evaluation of Denting Strength | Evaluation of Buckling Strength | Note |
|---|---|---|---|---|---|
| 1 | 60 | 216 | ○ | ○ | Example |
| 2 | 57 | 208 | ○ | X | Comparative Example |
| 3 | 61 | 207 | ○ | X | Comparative Example |
| 4 | 57 | 208 | ○ | X | Comparative Example |
| 5 | 60 | 205 | ○ | X | Comparative Example |
| 6 | 57 | 205 | ○ | X | Comparative Example |
| 7 | 68 | 201 | ○ | X | Comparative Example |
| 8 | 55 | 208 | X | X | Comparative Example |
| 9 | 51 | 215 | X | ○ | Comparative Example |
| 10 | 75 | 206 | ○ | X | Comparative Example |
| 11 | 61 | 218 | ○ | ○ | Example |
| 12 | 62 | 215 | ⊙ | ○ | Example |
| 13 | 65 | 216 | ⊙ | ○ | Example |
| 14 | 58 | 218 | ○ | ○ | Example |
| 15 | 67 | 220 | ○ | ○ | Example |
| 16 | 58 | 216 | ○ | ○ | Example |
| 17 | 62 | 219 | ○ | ○ | Example |
| 18 | 62 | 207 | ○ | X | Comparative Example |
| 19 | 61 | 209 | ○ | X | Comparative Example |
| 20 | 63 | 208 | ○ | X | Comparative Example |
| 21 | 61 | 206 | ○ | X | Comparative Example |
| 22 | 67 | 205 | ○ | X | Comparative Example |
| 23 | 59 | 206 | ○ | X | Comparative Example |
| 24 | 61 | 220 | ⊙ | ○ | Example |
| 25 | 61 | 219 | ⊙ | ○ | Example |
| 26 | 61 | 218 | ⊙ | ○ | Example |
| 27 | 61 | 227 | ⊙ | ⊙ | Example |
| 28 | 65 | 227 | ⊙ | ⊙ | Example |

* An underlined portion indicates a value out of the range according to the present invention.

All the examples of the disclosed embodiments had a hardness (HR30T) of 56 or more, an average Young's modulus of 215 GPa or more, and a denting strength of 70 N or more, and were excellent in terms of buckling strength of a can body. On the other hand, the comparative examples were poor in terms of at least one of the properties described above.

The invention claimed is:

1. A steel sheet for a can, the steel sheet having a chemical composition comprising:

C: 0.0016% or more and 0.0030% or less, by mass %;

Si: 0.05% or less, by mass %;

Mn: 0.50% or more and 1.00% or less, by mass %;

P: 0.030% or less, by mass %;

S: 0.020% or less, by mass %;

Al: 0.01% or more and 0.04% or less, by mass %;

N: 0.0010% or more and 0.0050% or less, by mass %;

B: 0.0005% or more and 0.0050% or less, by mass %; and

Fe and inevitable impurities, wherein the steel sheet has a hardness (HR30T) of 56 or more and an average Young's modulus of 215 GPa or more.

2. The steel sheet for a can according to claim 1, wherein the chemical composition of the steel sheet further comprises Ti: 0.005% or more and 0.020% or less, by mass %.

3. A method for manufacturing the steel sheet for a can according to claim 1, the method comprising:

hot-rolling a steel slab with a finishing delivery temperature of 800° C. or higher and 950° C. or lower to produce a steel sheet, the steel slab having a chemical composition comprising:

C: 0.0016% or more and 0.0030% or less, by mass %,

Si: 0.05% or less, by mass %,

Mn: 0.50% or more and 1.00% or less, by mass %,

P: 0.030% or less, by mass %,

S: 0.020% or less, by mass %,

Al: 0.01% or more and 0.04% or less, by mass %,

N: 0.0010% or more and 0.0050% or less, by mass %,

B: 0.0005% or more and 0.0050% or less, by mass %, and

Fe and inevitable impurities, coiling the hot-rolled steel sheet at a coiling temperature of 500C or higher and 700° C. or lower, cold-rolling the coiled steel sheet with a rolling reduction of 85% or more, annealing the cold-rolled steel sheet at an annealing temperature of 680° C. or higher and 780° C. or lower, and performing second cold rolling with a rolling reduction of 5% or more and 15% or less, wherein the cold-rolled steel sheet has a chemical composition comprising C: 0.0016% or more, and 0.0030% or less, by mass %.

4. The steel sheet for a can according to claim 1, wherein the steel sheet has a hardness (HR30T) of 58 or more and 70 or less.

5. The steel sheet for a can according to claim 1, wherein the steel sheet has an average Young's modulus of 225 GPa or more and 230 GPa or less.

6. The method according to claim 3, wherein the chemical composition of the steel slab further comprises Ti: 0.005% or more and 0.020% or less, by mass %.

7. The steel sheet for a can according to claim 1, wherein a ratio Al/B is in a range of 6.0 or more to 25.0 or less.

8. The steel sheet for a can according to claim 1, wherein C: 0.0018% or more and 0.0030% or less, by mass %.

* * * * *